United States Patent [19]

Steiner et al.

[11] Patent Number: 4,901,641

[45] Date of Patent: Feb. 20, 1990

[54] PRINTING PRESS

[75] Inventors: Jean-Pierre Steiner, Montville; Thomas Byro, Ringwood, both of N.J.

[73] Assignee: Bobst SA, Switzerland

[21] Appl. No.: 278,031

[22] Filed: Nov. 30, 1988

[51] Int. Cl.[4] ..... B41F 9/02; B41F 9/10; B41F 13/20

[52] U.S. Cl. ..... 101/152; 101/350; 101/157; 101/216

[58] Field of Search ..... 101/152, 153, 154–157, 101/169, 216, 217, 218, 247, 219, 350, 157

[56] References Cited

U.S. PATENT DOCUMENTS 3,625,145 12/1971 Heatlen, Jr. ..... 101/152

4,046,070 9/1977 Halley ..... 101/216

*Primary Examiner*—J. Reed Fisher

*Attorney, Agent, or Firm*—Hill, Van Santen, Steadman & Simpson

[57] ABSTRACT

A printing press unit for a printing press system which has a main frame with an impression roller mounted for rotation on a first axis characterized by a sub-frame being mounted for pivotal movement around a second axis and supporting a printing cylinder which will be moved into contact with the web passing between the impression roll and the cylinder. The sub-frame can be laterally adjusted along the second axis and the second axis can be skewed as necessary for purposes of registration of the web during a printing process. For a rotogravure printing, the ink applicator and doctor blade holder are both releasably mounted on positoning assemblies which are provided on the sub-frame. In addition, an ink pad is held beneath the printing cylinder by an arm, which can is pivotably connected to the main frame and can be vertically raised and lowered so that the pan receives the cylinder as it is released from the sub-frame, then lowers the cylinder to a level to clear the portions of the press and is then pivoted out of the press for exchange. During this exchange, the ink applicator and doctor blade holder can also be quickly removed. The press can also be modified to receive an inking and transfer roller for a flexo printing process as the printing roller is mounted in the first sub-frame.

17 Claims, 8 Drawing Sheets

FIG. 13
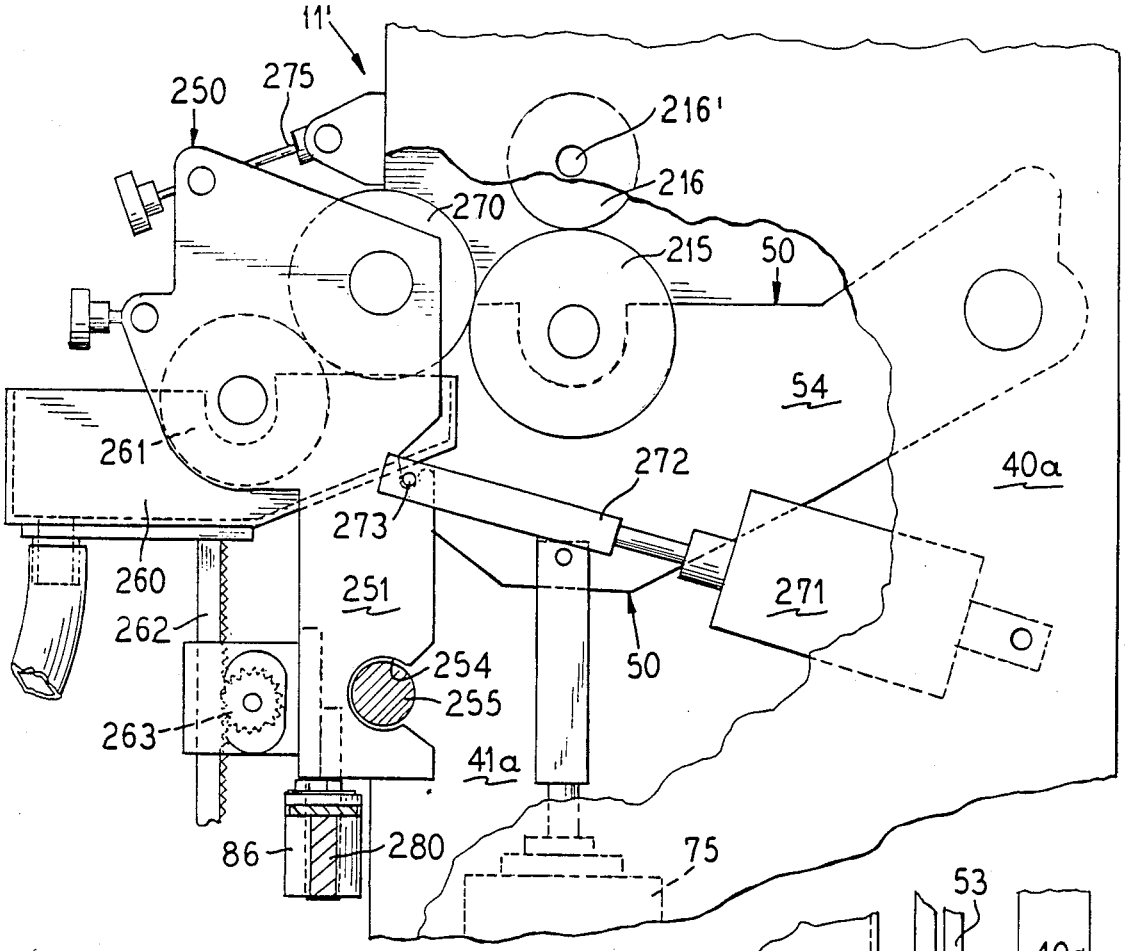
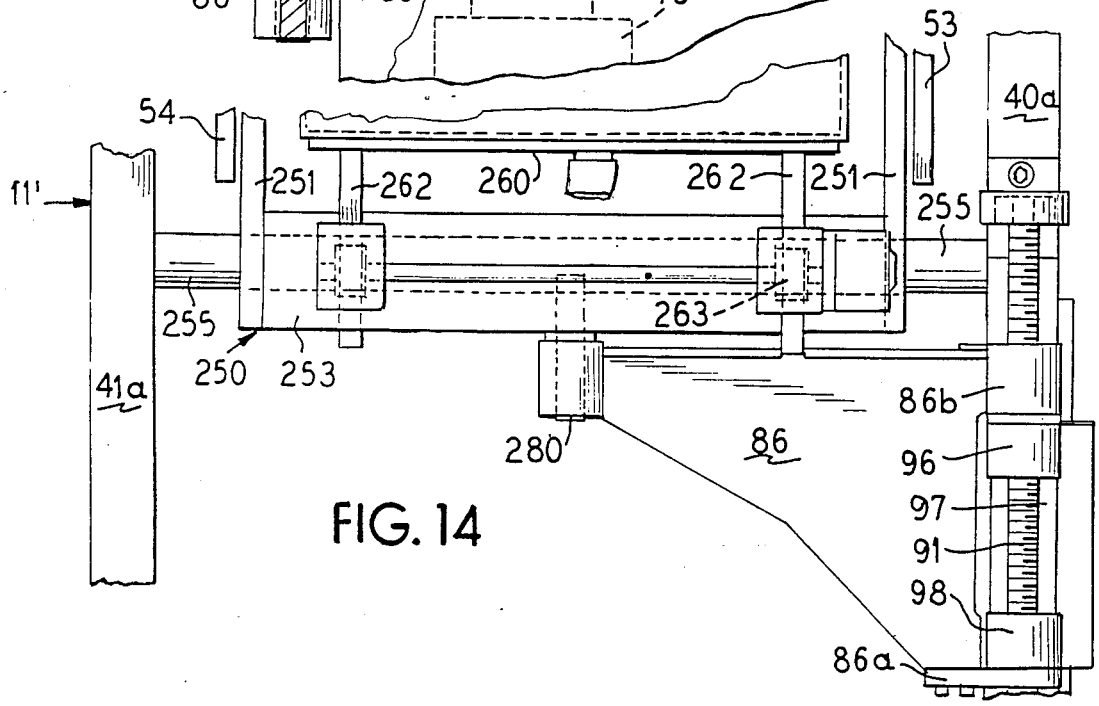
FIG. 14

PRINTING PRESS

BACKGROUND OF THE INVENTION

The present invention is directed to a printing press unit for printing on a web of material as the web passes through a printing station formed by an impression roll and a printing cylinder.

In a printing press unit, such as a rotogravure, a printing station is formed between an engraved cylinder and an impression roll. The engraved cylinder, along with the ink applicator and doctor blade are mounted on a carriage or cart which is removable from the press with a second or other cart having a new printing cylinder being inserted to enable changing the printing cylinders. An example of such an arrangement is disclosed in U.S. Pat. No. 3,625,145, whose disclosure is incorporated by reference thereto. One difficulty with this arrangement is that the impression roller is mounted for vertical displacement to insure contact with the printing cylinder of different sizes carried by the same carriage. Thus, when changing printing cylinders of different sizes, problems arise because of the change in the length of the web being fed through the press.

Another difficulty with this known type of printing arrangement is that a large number of extra carriages are required for supporting the various printing cylinders that are to be inserted into the press. This increases the cost of operation because of the expense of each of these carriages or carts due to the fact that the carriage or cart includes not only the doctor blade but the assembly for positioning the doctor blade and an assembly for positioning the ink applicator relative to the printing cylinder and the ink pan. In addition, this large number of extra carts that are necessary in order to have a fast changeover require additional space for storage when not being used.

SUMMARY OF THE INVENTION

The present invention is directed to an improved printing press which, while preferably a rotogravure press, can also be used with an adaptation as a flexo printing press. Each unit of the improved press has a main frame having a pair of side frames spaced apart for each press unit, an impression roll mounted for rotation on a first axis extending between a pair of side frame members, a sub-frame, means mounting the sub-frame on the main frame for pivotal movement around a second axis offset from the first axis, said means for mounting including a lateral movement cf the sub-frame on said second axis and skewing of the second axis relative to the first axis, said sub-frame having chucking means for releasably mounting a printing cylinder for rotation in the sub-frame on a third axis, means for pivoting the sub-frame on said second axis to move a surface of the printing cylinder into printing engagement with a web extending between the printing cylinder and impression roll, inking means for applying printing ink to the surface of the printing cylinder, web guide means including a plurality of rollers mounted to extend between said side frame members for receiving a web entering the press, guiding the web to pass between the impression roll and the printing cylinder and for guiding the web out of the press and means mounted on the sub-frame for rotating at least the printing cylinder. printing cylinder and the ink pan. In addition, this large number of extra carts that are necessary in order to have a fast changeover require additional space for storage when not being used.

SUMMARY OF THE INVENTION

The present invention is directed to an improved printing press which, while preferably a rotogravure press, can also be used with used with an adaptation as a flexo printing press. Each unit of the improved press has a main frame having a pair of side frames spaced apart for each press unit, an impression roll mounted for rotation on a first axis extending between a pair of side frame members, a sub-frame, means mounting the sub-frame on the main frame for pivotal movement around a second axis offset from the first axis, said means for mounting including a lateral movement of the sub-frame on said second axis and skewing of the second axis relative to the first axis, said sub-frame having chucking means for releasably mounting a printing cylinder for rotation in the sub-frame on a third axis, means for pivoting the sub-frame on said second axis to move a surface of the printing cylinder into printing engagement with a web extending between the printing cylinder and impression roll, inking means for applying printing ink to the surface of the printing cylinder, web guide means including a plurality of rollers mounted to extend between said side frame members for receiving a web entering the press, guiding the web to pass between the impression roll and the printing cylinder and for guiding the web out of the press and means mounted on the sub-frame for rotating at least the printing cylinder.

Preferably, the inking means includes an applicator mounted on the sub-frame, a doctor blade being mounted by a positioning assembly on the sub-frame and an ink pan which is mounted under the printing roll by an arm which is mounted for pivotal movement on one of the side frame members around a vertical axis and is adjusted along the vertical axis so that the side arm can be used to remove the printing cylinder by being raised so that the ink pan supports the cylinder, releasing the cylinder from the chuck means, then lowering the cylinder and swinging the arm in a pivotal movement to remove the cylinder from the press, wherein the pan and cylinder can be removed and a new pan and cylinder are inserted. Then, the arm is pivoted underneath the position for the cylinder, raised to present the new cylinder on the axis to be gripped by the chucking means and the pan is then lowered to the operational position.

If a flexo printing arrangement is used, the arm can be used for positioning a second sub-frame which has an ink pan, an inking roll and a transfer roll. The frame of the press is modified to provide a pivot mounting and to hold the transfer roll in the desired contact with the printing cylinder. When changing the printing cylinder, the transfer arm is first used to remove the sub-frame having the ink pan, inking roll and transfer roll, and then is provided with a pan and moved into a position for supporting the cylinder as it is being removed.

The press unit of the invention has many advantages over the previously known presses, such as the impression roll being in a substantially fixed position so that the length of the web entering the printing station remains the same regardless of changes of the printing cylinder. The sub-frame can be moved vertically upward to apply the desired pressure of the printing cylinder on the web at the printing station that is passing between the printing cylinder and the impression roll. In addition, the sub-frame's pivoting allows changing the diameter of the printing rolls without changing the length of the web entering into and removed from the printing station because the position of the impression roll remains the same. The sub-frame can also be moved laterally for purposes of registration of the web and can be skewed on the second axis as desired.

Another advantage of applicants' invention, particularly when used in a rotogravure press, is that when changing the color and printing cylinder, only the printing cylinder, ink pan, the doctor blade and applicator are removed while the positioning assemblies for supporting the doctor blade and the ink applicator remain in the press. A third improvement is that the rotogravure cylinder and pan are removed together with the pan supporting the cylinder during the step of replacement.

Other advantages and features of the invention will be readily apparent from the following description of the preferred embodiments, the drawings and claims.

BRIEF DESCRIPTION OF THE DRAWINGS

FIG. 13 is a schematic side view with portions broken away illustrating the flexo option for attaching a flexo printing arrangement in the unit; and FIG. 14 is a partial view taken on line XIV—XIV of FIG. 13.

DESCRIPTION OF THE PREFERRED EMBODIMENTS

Figure 1:
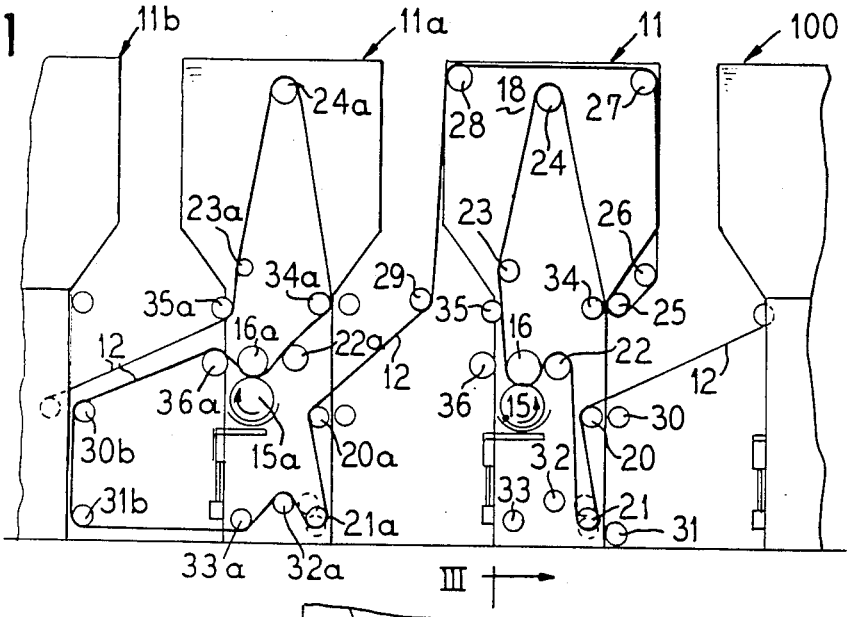
FIG. 1 is a side elevational view schematically showing several printing stations or unit in a printing apparatus in accordance with the present invention.

The principles of the present invention are particularly useful when incorporated in a printing system, generally indicated at 100, which has a plurality of printing units, generally indicated at 11, 11*a* and 11*b*, arranged one after another for acting on a web 12 of material being fed through the units. Each of the units 11 has a printing station formed by a printing cylinder 15 coacting with an impression roller or cylinder 16, through which the web 12 passes.

In addition, each of the units has guide means comprising a plurality of rolls, which guide the web 12 through the printing station and into a drying chamber 18 that is positioned above the printing cylinder 15. As illustrated, each of the guide means includes a plurality of rolls 20–36. As illustrated in the unit 11, the web 12 enters the unit 11 and passes over a roll 20 around an adjustable take-up roll 21 and goes to a guide roll 22. From the guide roll 22, it passes between the impression roll 16 and the printing cylinder 15 and then goes to a guide roll 23. From the guide roll 23, it goes to the guide roll 24, which is in the drying chamber, back to a guide roll 25 to guide roll 26, 27, 28 and then to guide roll 29. This arrangement is for printing side down and the printing cylinder 15 is rotated in a counterclockwise direction, as indicated by the arrow.

In the next station or unit 11*a*, the guide rolls are illustrated for guiding in a printing side up and, thus, from the roll 29 of station 11, the web 12 goes to roll 20*a* to the take-up roll 21*a* to the guide roll 32*a*, then to a guide roll 33*a*. From the guide roll 33*a*, the web then goes to a guide roll 31*b* of the unit 11*b*, then to roll 30*b*, back to roll 36*a* for guidance between the printing cylinder 15*a* and impression roller 16*a*. From the printing cylinder 15*a*, the web then goes to the roller 22*a*, roller 34*a*, roller 24*a* to roller 23*a* and, finally, to roller 35*a*, where the web then leaves the unit or press 11*a* and goes to press 11*b*. In press 11*a*, the printing cylinder 15*a* is rotating in the clockwise direction, as illustrated by the arrow.

Figure 2:
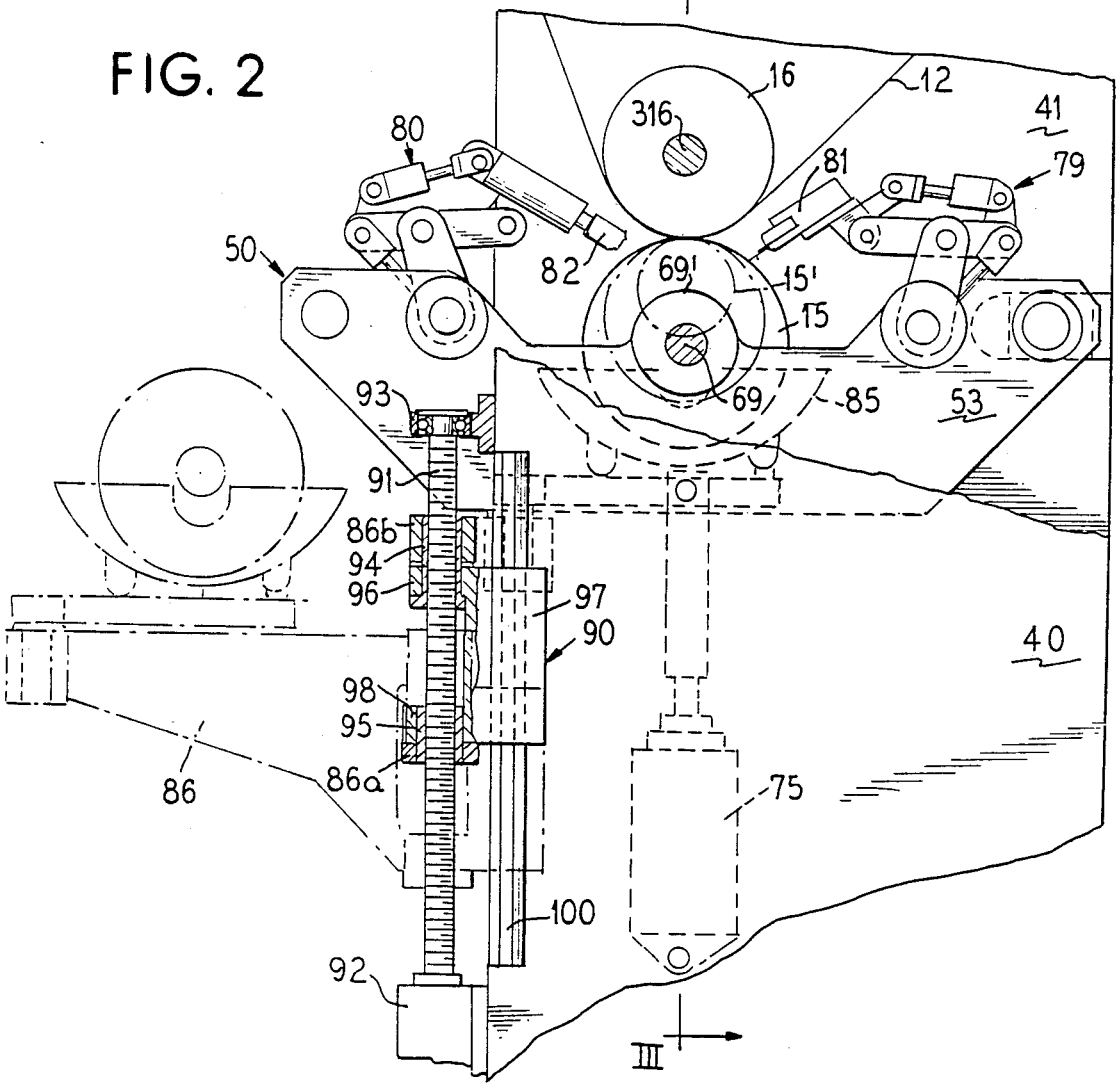
FIG. 2 is an enlarged partial side view with portions broken away illustrating the position of a printing cylinder and impression roll and also showing a support for supporting the ink pan in various positions, including a partially pivoted out position during removal of the pan and cylinder.
Figure 3:
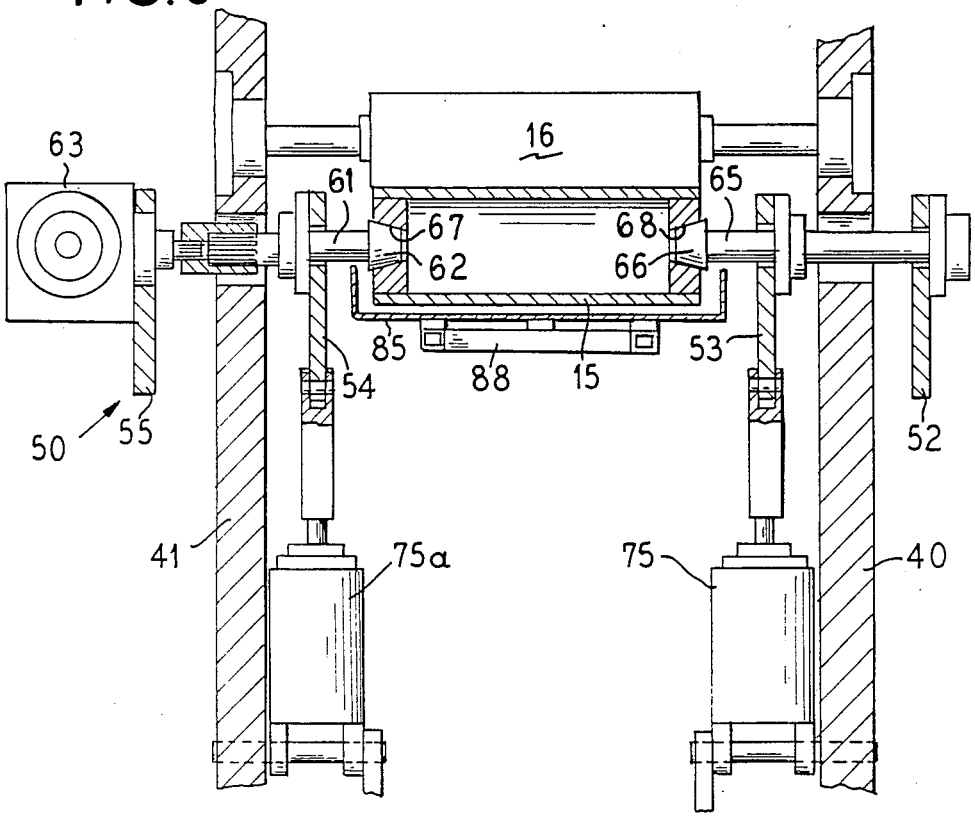
FIG. 3 is a cross sectional view taken along the lines III—III of FIG. 2.
Figure 9:
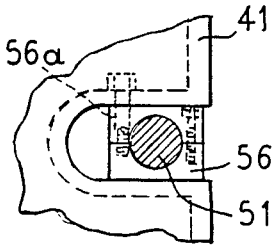
FIG. 9 is a partial cross sectional view taken on line IX—IX of FIG. 8.
Figure 10:
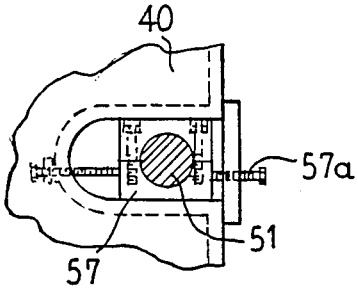
FIG. 10 is a partial cross sectional view taken on line X—X of FIG. 8.
Figure 8:
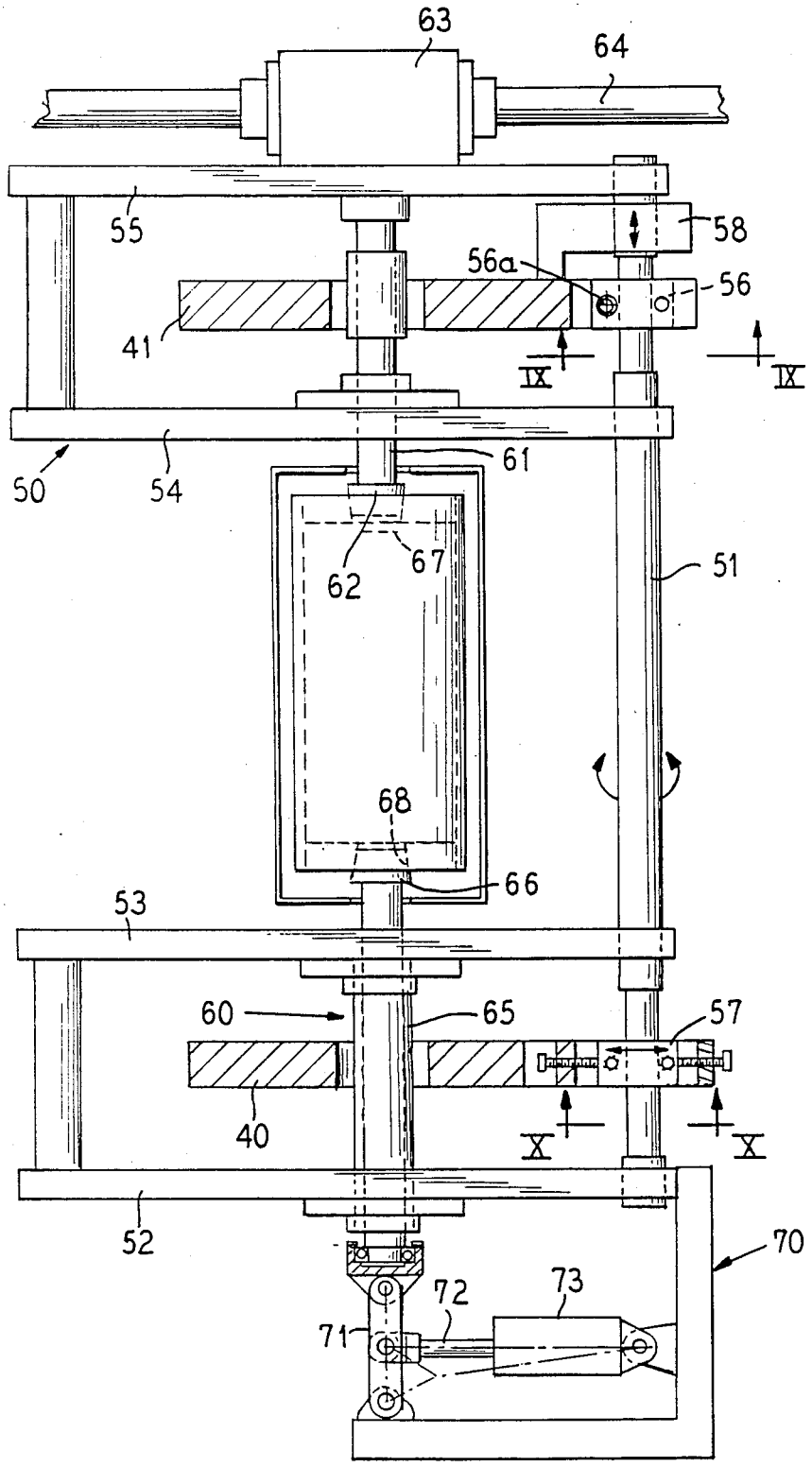
FIG. 8 is a diagrammatic plan view of the sub-frame schematically showing the means for moving the frame laterally on a second axis, the means for skewing the second axis and the chucking means.

Each of the printing units 11 has a main frame comprising two main frame members, such as 40 and 41 illustrated in FIG. 3. As mentioned hereinabove, the impression roll is mounted for rotation in the main frame on a first axis 316 and extends between the two frame members 40 and 41. The printing cylinder 15 is mounted in a sub-frame, generally indicated at 50 in FIG. 2, and, as best illustrated in FIG. 8, comprises an axle 51, a first plate 52, a second plate 53, a third plate 54 and a fourth plate 55. Each of the plates 52, 53, 54 and 55 at one end are rigidly connected to the axle 51 to rotate therewith. The axle 51 has a length greater than the spacing between the side frame members 40 and 41 and is mounted in the main frame so that the first and second plates 52 and 53 extend on opposite sides of the side frame member 40, while the third and fourth plates 54 and 55 extend on opposite sides of the side frame member 41. As illustrated, the sub-frame 50, which is also a floor plate assembly, is mounted in the side frame members 40 and 41 by bearing means, such as 56 and 57. To allow for lateral alignment, means 58 are provided for laterally shifting the axle 51 on a second axis in the bearings 56 and 57. The bearing 56 is mounted for pivotal movement by a pin 56*a*, as illustrated in FIG. 9, and the bearing means 57 can be shifted by a threaded arrangement, such as 57*a*, as illustrated in FIG. 10, so that the axis of the axle 51 can be shifted about a pivot point formed by the bearing 56. This will cause skewing, which enables obtaining the desired alignment of the web during the printing operation along with the desired lateral offset. The skewing and lateral offset are done in a conventional manner, the exception being that in known printing presses, usually the axis of rotation of the printing cylinder is skewed and laterally offset instead of an entire sub-frame.

As illustrated in FIG. 8, chucking means, which is generally indicated at 60, includes a fixed axle 61, which has a conical head or end 62, is mounted in a fixed fashion for rotation in the third and fourth plates 54 and 55 and is connected to a gear box 63 for a drive shaft, such as 64. On the opposite side is a movable axle or shaft 65, which is mounted both for rotational movement and for axial movement in the plates 52 and 53. The movable axle 65 also has a conical head or end 66. The chucking means 60 engages the cylinder 15 by having the conical or tapering end 62 and 66 engaged in conical or tapering bores 67 and 68, respectively, of the cylinder 15.

In order to complete the chucking means, a clamping arrangement 70 is provided and acts on the movable shaft 65 with a toggle arrangement 71. As illustrated, a shaft 72 of an actuator 73 shifts a link of the toggle. Such an arrangement of the toggle allows developing a very high clamping force. It is noted that the shaft 61, as mentioned before, is fixed in bearings on the plates 54 and 55 and extends through an opening in the side frame member 41. The shaft 65 also extends through a large opening in the member 40 and is mounted in bearings which both allow rotation and axial sifting. It should be noted that the openings in both the frames 41 and 40 are enlarged to allow movement of the axles 61 and 65 with the sub-frame 50 as it pivots around the second axis of the axle 51.

As best illustrated in FIGS. 2 and 3, means formed by pneumatic actuators 75, 75*a* are provided for pivoting the sub-frame 50 about the second axis. These means are illustrated as comprising a cylinder 75, which is pivotably mounted on a side member 40 and is connected to the second plate 53 while the other actuator 75*a* is connected to the side frame 41 and is coupled to the third plate 54. As illustrated in FIG. 2, the chucking means 60 chucks the cylinder 15 on a third axis 69, which extends parallel to the second axis of the axle 51. This axis 69 is the same, regardless of the size of the cylinder. Thus, if a 20-inch diameter cylinder 15 is utilized, as shown in bold lines in FIG. 2, the frame 50 is moved to bring the surface of the cylinder in engagement with the web. However, if a 10-inch diameter printing cylinder is used, such as the cylinder 15', then the frame 50 is moved to shift the second axis to the position 69' with the surface engaging the web at the printing station. As can be readily seen, a changing of the size of the printing cylinder between 15 and 15' will not cause any change in the path of the web 12 and require any special adjustments of the web.

As illustrated in FIG. 2, in addition to the chucking means, the frames are provided in a positioning assembly, generally indicated at 79, which is pivotably mounted on the inner two plates 53 and 54, on the right side of the printing cylinder 15. As illustrated in FIG. 2, a second positioning assembly, generally indicated at 80, is pivotably mounted on the left side of the cylinder 15. In FIG. 2, the assembly 79 on the right side of the cylinder 15 has a doctor blade holder 81 releasably connected thereto, while the second assembly 80 supports an ink applicator 82 that is also releasably held thereon. As mentioned above, the openings for the shafts or axles of the chucking means are sufficiently big enough in the side frames that the doctor blade holder can be removed therethrough when the doctor blade holder 81 is released from the positioning assembly 79. In a similar manner, the ink applicator 82 can be released and withdrawn through this opening.

It also should be pointed out that, as illustrated in FIG. 2, the cylinder 15 is rotating in a counterclockwise direction. If the cylinder was being rotated in a clockwise direction, then the doctor blade holder 81 would be releasably mounted on the positioning assembly 80, while the ink applicator 82 would be releasably mounted on the positioning assembly 79.

Figure 11:
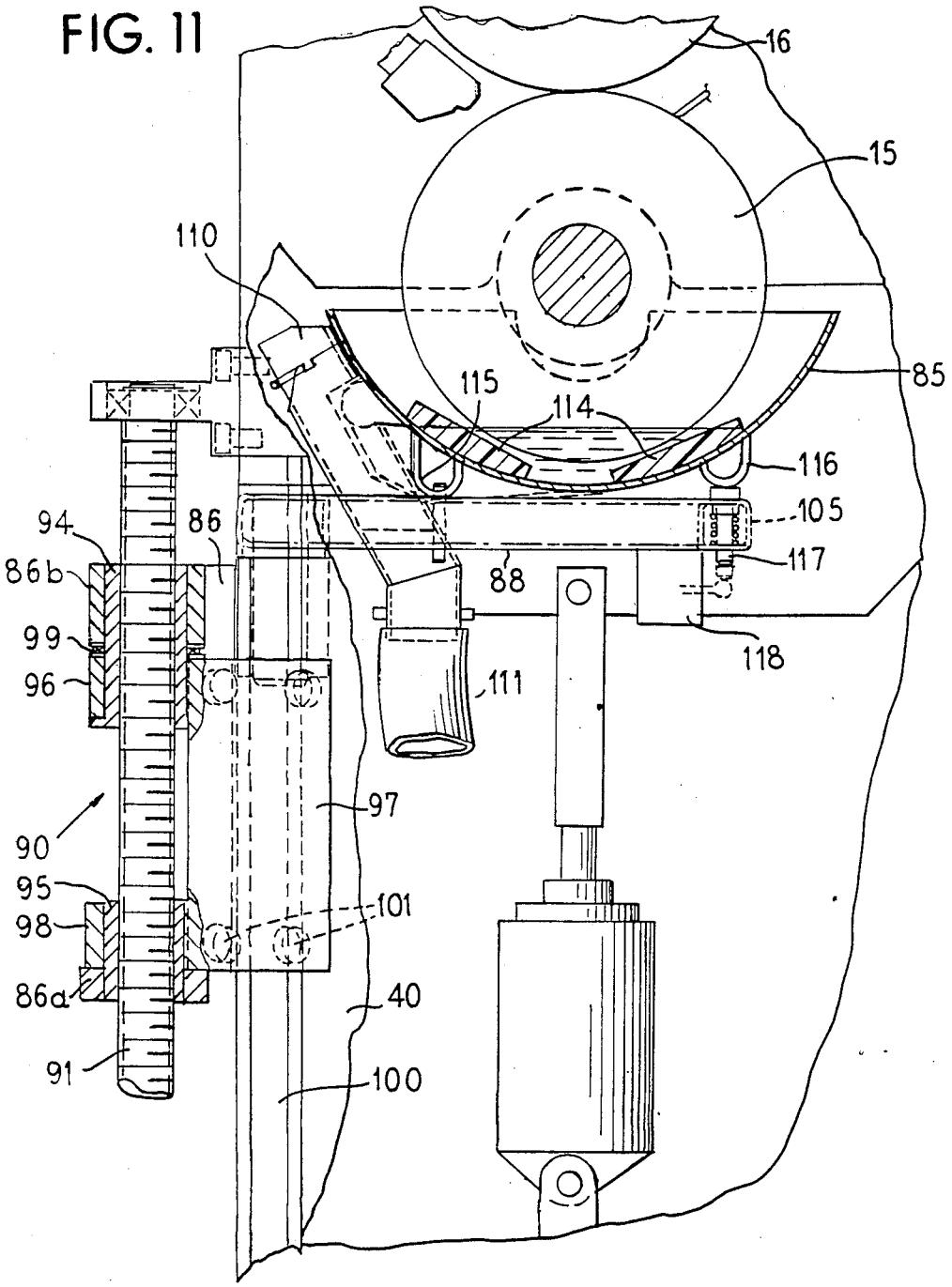
FIG. 11 is a cross sectional view of the ink pan and the pan mount in detail.
Figure 12:
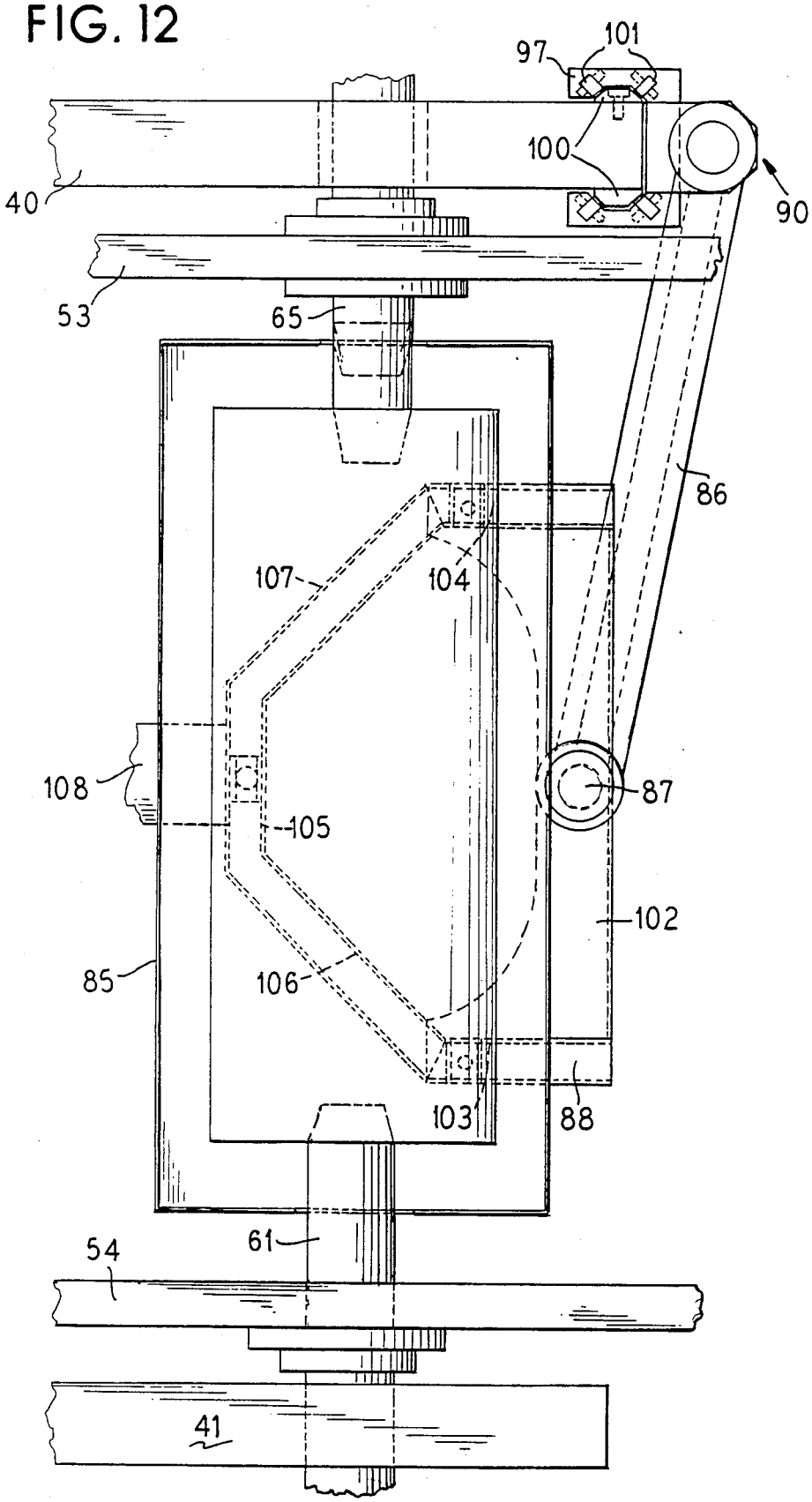
FIG. 12 is a partial plan view of the unit showing the frame for the pan mount.

Referring to FIGS. 2, 3, 11 and 12, an ink pan 85 is supported beneath the printing cylinder 15 by an arm 86. The arm 86, at a free end, is pivotably connected by a pivotable connection 87 to a pan frame support 88 (see FIG. 12). At the opposite end, the arm 86 is connected to an arm mounting means, generally indicated at 90 in FIGS. 2, 11 and 12, to the side frame member 40. The arm mounting means 90, as illustrated in FIGS. 2 and 11, includes a threaded shaft 91, which is driven by a motor 92 mounted on the side frame member 40. An upper end of the threaded shaft 90 is supported by a bearing block 93 on the side frame. Threaded nuts or sleeves 94 and 95 are threaded on the shaft 91, as best illustrated in FIG. 11. The threaded sleeve 94 is connected to a portion 96 of a carriage 97, which also has a portion 98 receiving the sleeve nut 95. The arm 86, as illustrated in FIG. 14, has a bottom plate 86*a*, which is received on the bottom sleeve nut 94 and is attached to the plate forming the arm 86. At an upper end, a hub 86*b* is received on the sleeve nut 95 (FIG. 11) and spaced from the portion 96 by a thrust bearing 99. As best illustrated in FIG. 12, the carriage 97 rides on track members 100, which are secured on an end of the side frame 40 and to facilitate the vertical movement on the track members 100 is provided with a plurality of rollers, such as 101. Thus, with rotation of the screw 91, which lies on a vertical axis parallel to the track formed by the track members 100, the carriage 97 and arm 86 move in a vertical direction or axis. The sleeve nuts 94 and 95 form bearings to allow pivotable movement of the arm 86 around the vertical axis.

The frame 88 has an open configuration with a portion or back member 102 (FIG. 12) which has a pin that is received in a socket at the end of the arm 86 to form the pivotable connection 87. The frame also has two parallel side portions 103 and 104, which terminate approximately half the distance from the back member 102 and has a front or forward portion 105 which extends parallel to the back member 102 and is connected by a slanting member 106 to the end of the side frame portion 103 and 107 to the side portion 104. The front portion 105 engages a stop 108 of the sub-frame 50 to orient the frame and pan 85.

The ink pan 85 (FIG. 11) has a curved configuration with a portion forming a drain line 110 connected to one side, which portion 110 can be connected to a hose 111 for a return to an ink sump for the printing device. The drain line 110, as mentioned, forms a portion of the pan 85 and the pan 85 is provided with pads 114, 114 which are composed of a material, such as nylon, and will engage the printing surface of the cylinder 15 when the pan 85 is raised into contact with the cylinder to support the cylinder. The pan 85, as mentioned hereinabove, is removable from the frame 88 and, as illustrated, the pan is provided with three U-shaped feet, such as 115 and 116. The feet, such as 115 are caught on pins or hooks to be held on the frame while the foot 116 rests on a yieldable pin 117 which, when pushed to a downward position, actuates a limit switch, such as 118, to indicate that the pan 85 is in contact with the surfaces of the cylinder 15 and cannot be moved any further in an upward vertical direction.

Figure 4:
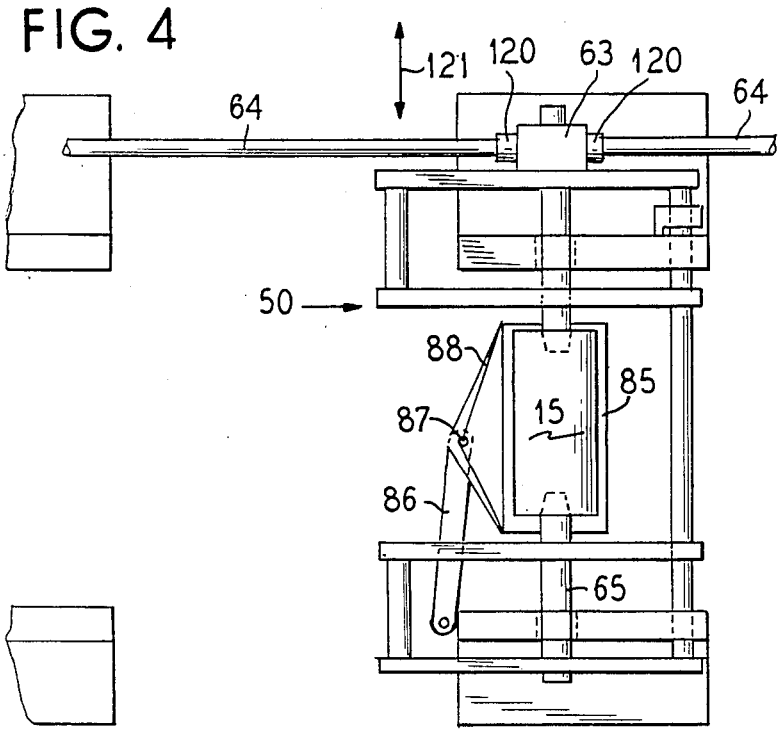
FIG. 4 is a diagrammatic plan view showing offsetting of the sub-frame and connection of the drive shaft from one press unit to another.

As illustrated in FIG. 4, each of the gear boxes 63 is connected by a drive shaft 64 to the next adjacent gear box or either the following or the preceding press unit. These connections are formed by universal joints 120 so that when the sub-frame 50 is shifted laterally, the gear box 63 moves with the sub-frame and the joints 120 compensate for the various shifting. Thus, movement of the sub-frame 50 in the direction of the double-arrow 121 is compensated by these joints 120.

Figure 5:
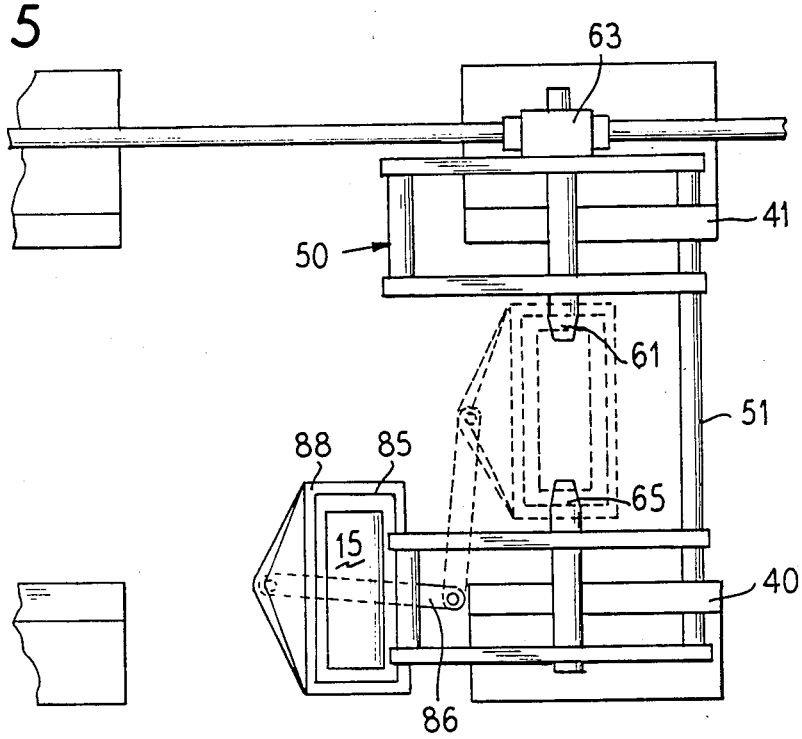
FIG. 5 is a diagrammatic plan view similar to FIG. 4 showing the ink pan and printing cylinder as it is being partially moved out during an exchange of the pan and cylinder.
Figure 6:
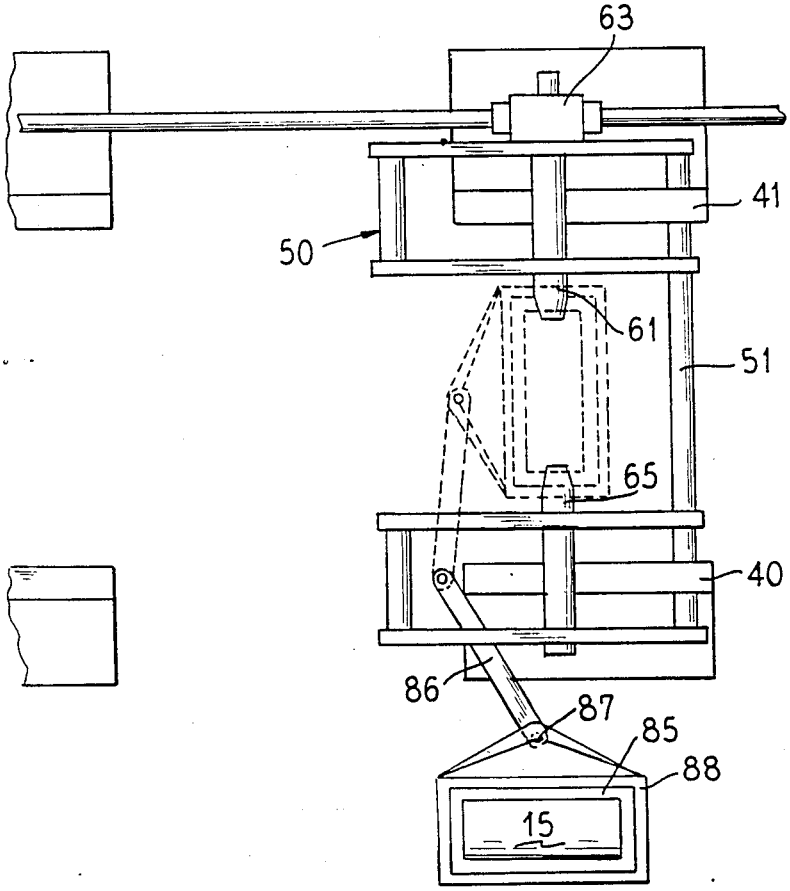
FIG. 6 is a diagrammatic plan view similar to FIG. 5 with the pan and cylinder in the completely removed position for exchanging the pan and cylinder.

FIGS. 4, 5 and 6 also diagrammatically illustrate the arm 86, the pivot connection 87, along with the frame 88 that supports the ink pan 85. These portions are all illustrated in FIGS. 4, 5 and 6. While in the position illustrated in FIG. 4, the mounting means 90 is raised until the ink pan 85 engages the surface of the printing cylinder 15. Then, the chucking means is released to disengage the cylinder 15, which is now resting on the pads 114 of the ink pan 85. In the next step, the mounting means 90 is actuated to lower the arm 86, the frame 88 and the ink pan 86 with the cylinder 15 to a position sufficiently low enough, as illustrated in chain lines in FIG. 2, so that the arm can be pivoted around the vertical axis formed by the mounting means 90 to an intermediate position, such as illustrated in FIG. 5 in bold lines. It is noted that, because of the pivot connection 87, the frame 88 supporting the pan 85 will pivot to a position so that there is adequate clearance between the unit and the next following unit. Continued pivoting brings the arm 86, the pan 85 and frame 88 to the position illustrated in FIG. 6, wherein the pan, along with the cylinder can be removed from the frame 88 and replaced by a new ink pan containing a new cylinder. At the same time, as mentioned above, the doctor blade holder and the ink applicator are removed from their support or positioning assemblies.

To insert the new cylinder and new pan, the next step is to swing the arm to the position, such as illustrated in FIG. 4, wherein the frame, such as the frame member 105, will engage the stop member 108 to insure that the frame and the pan supported thereon have the desired orientation. Then, the mounting means 90 is raised until the new cylinder and the pan contacts the impression roll 16, which causes actuation of the switch 118 to stop the vertical movement. Then, the sub-frame 50 is positioned so that the third axis of the chucking means 60 is aligned with the cylinder, and the movable shaft 65 of the chucking means is moved to cause the clamping or chucking of the cylinder. Following this action, the arm mounting means 90 is lowered to position the inking pan in the desired relationship relative to the cylinder, such as illustrated in FIG. 2. Prior to inserting the new cylinder, the new ink applicator and the new doctor blade holder can be inserted in their respective positioning assemblies 79 and 80.

Figure 7:
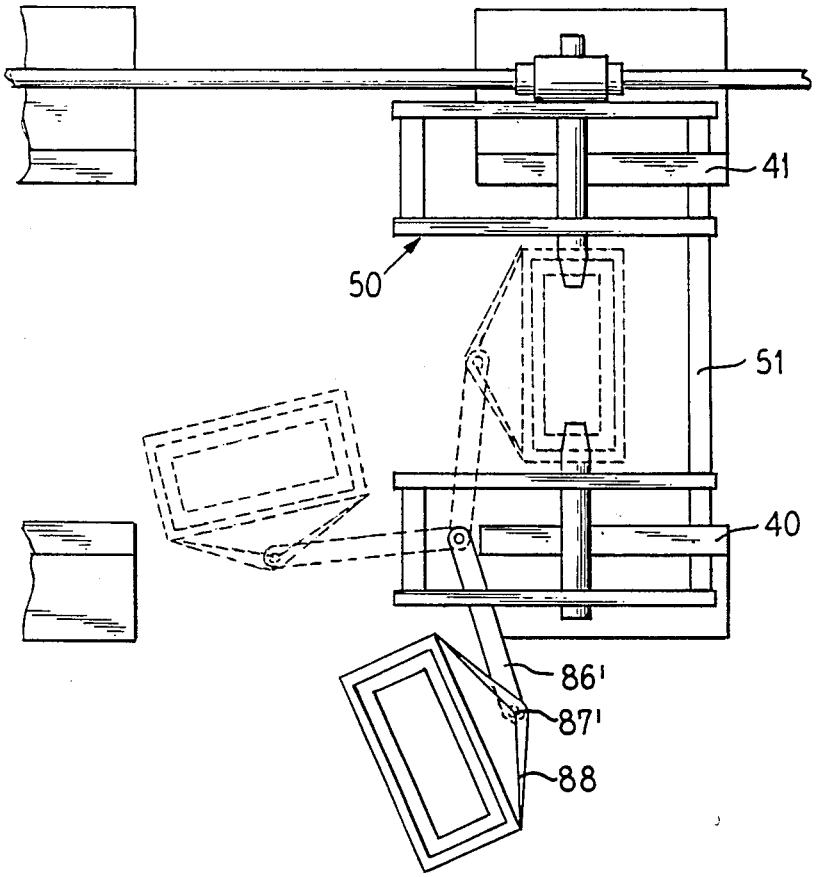
FIG. 7 is a diagrammatic plan view similar to FIGS. 4, 5 and 6 showing a modification of the arm arrangement with an intermediate position shown in dotted lines and the final removed position shown in bold lines.

In the above-described description, the arm 86 has two pivotable connections, one to the frame 88 and the other one formed by the connection to the arm mounting means 90. FIG. 7 diagrammatically shows a modification wherein an arm 86' has a fixed connection 87' to the frame 88 so that the frame is always in the same relationship to the arm as it is moved from a position beneath the third axis of the chucking means 60 to the outward position shown in bold lines. While this requires additional space for clearance between the units, it does have the advantage of having the proper orientation for the cylinder received in the pan as a new cylinder is being moved into a position for being grasped by the chucking means 60.

It is sometimes desirable to be able to convert the rotogravure unit 11 into a unit which can handle flexo printing. To accomplish this, as illustrated in FIGS. 13 and 14, the impression roller is provided with a flexo impression roller 216 that is mounted for rotation on a first axis 216'. The previous printing cylinder is replaced by a flexo printing cylinder 215, which is held by the chucking means in the sub-frame 50. Since, in a flexo printing, only a kiss-type contact is maintained, the flexo printing roll 215 has a gear which meshes with a gear on the shaft of the impression roll 216 so that both rolls move at the same peripheral surface speed. When positioning the roller, such as 215, in the sub-frame 50, an ink pan arrangement on the arm 86 is utilized.

After positioning the flexo printing roller 215, a second sub-frame 250 having a pair of side frames 251 spaced apart a distance to enable them to be inserted between the inner two plates 53 and 54. Adjacent the bottom portion of the sub-frame 250, a plate 253 extends between the two side frames 251. Each of the side frames 251 is provided with a notch 254 for receiving a pivot pin 255, which is mounted on the inner surface of each of the side frames **40*a* and 41*a* of the main frame for the modified press unit 11'**.

Mounted between the two side frames 251 is an inking pan 260 which rotatably supports and inking roller 261 that has its own separate drive unit or motor. The inking pan 260 is mounted for vertical adjustment relative to the second frame 250 by a rack-and-pinion arrangement, including the rack 262 and pinions 263, which pinions are mounted on a shaft 264 that is rotated by a motor 265 and is mounted on the plate 253. Mounted for rotation in the frame 250 is a transfer or anilox roller 270 (FIG. 13), which has a gear that will mesh with a gear on the printing roller 215 so that when a kissing surface contact is therebetween, the rollers will be driven at the same surface speed.

To pivot the frame 250 to bring the roller 270 into surface contact with the printing roller 215 and to engage the meshing gears, an actuator 271 is mounted on each of the side frames **40*a* and 40*b* and has a ram 272 with a pin 273 engaged in a catch on each of the side frames 251. To control the amount of pressure between the roll 270 and the roll 215, an adjustable stop 275 is provided. The sub-frame 250 is brought into position by the pivot arm 86, which has a socket to receive a pin 280 on the plate 253, as illustrated in FIGS. 13 and 14, and then the pivot arm is lowered to be moved out of engagement. During operation, contact between the printing roll or cylinder 215 and the impression roller 216 is controlled by the cylinder or actuator 75 by raising and lowering-the sub-frame 50. The pivoting of the second sub-frame 250 on the pivots points 255 controls the contact between the roller 270 and the cylinder 215** Raising and lowering of the ink Although various minor modifications may be suggested by those versed in the art, it should be understood that we wish to embody within the scope of the patent granted hereon all such modifications as reasonably and properly come within the scope of our contribution to the art.

We claim:

1. A printing press comprising a main frame having a pair of side frame members spaced apart, an impression roll mounted for rotation in said side frame members on a first axis extending between the pair of side frame members, a sub-frame, means mounting said sub-frame in the main frame for pivotal movement around a second axis offset from the first axis, said means for mounting enabling a lateral movement of the sub-frame on said second axis and skewing of said second axis relative to said first axis, said sub-frame having chucking means for releasably mounting a printing cylinder for rotation in the sub-frame on a third axis, means for pivoting the sub-frame on said second axis to move a printing surface of the printing cylinder into printing engagement with a web extending between said printing cylinder and said impression roll, inking means for applying printing ink to said printing surface of said printing cylinder, web-guide means including a plurality of rollers mounted to extend between said side frame members for receiving a web entering the press, guiding the web to pass between the impression roll and printing cylinder and for guiding the web out of the press, and means mounted on the sub-frame for rotating at least said printing cylinder.

2. A printing press according to claim 1, wherein said sub-frame comprises a first, second, third and fourth plate and a sub-frame axle, said first, second, third and fourth plates being mounted at one end rigidly on said axle in a spaced relationship, said axle having a length greater than the spacing between the two side frame members so that one side frame member extends between the first and second plates and the other side frame member extends between the third and fourth plates, said means for pivoting said sub-frame including two actuators, with one of the two actuators extending between the second plate and the one side member and the other actuator between the third plate and other side member.

3. A printing press according to claim 2, wherein the printing press is a rotogravure printing press with the printing cylinder being a rotogravure cylinder and said inking means includes an ink applicator and a doctor blade, and a positioning assembly mounted in the sub-frame on each side of the third axis with one positioning assembly releasably mounting the doctor blade and the other positioning assembly releasably mounting the ink applicator, said inking means also including an ink pan disposed beneath the printing cylinder.

4. A printing press according to claim 3, which includes means for removing the printing cylinder and said ink pan together, including an arm having one end mounting said ink pan, arm mounting means for supporting the other end of the arm for pivotal movement on one of the side frame members of the main frame, said arm mounting means including means for raising and lowering the position of the arm to enable raising the pan into engagement with said cylinder for supporting the cylinder when the cylinder is released by said chucking means, and then lowering the pan and cylinder and pivoting to move the cylinder and pan from the press, so that during changing of a cylinder and color of ink, the pan and cylinder are removed and the applicator and doctor blade assembly are removed while maintaining the positioning assemblies for the doctor blade and applicator in said press.

5. A press according to claim 4, wherein said pan is releasably connected to the arm in a fixed position.

6. A press according to claim 4, wherein said pan is mounted on the arm for pivotal movement so that the pan and cylinder can be pivoted relative to the arm as the arm is being pivoted about the arm mounting means.

7. A press according to claim 4, which includes a second subframe pivotably mounted on the one end of said second arm, said sub-frame releasably receiving the ink pan.

8. A press according to claim 4, wherein the printing cylinder is a sleeve cylinder having end walls with each end wall having a conical bore with a converging taper, said chucking means including a first axle mounted for rotation and extending between the third and fourth plates having a head with a tapering surface matching and taper of the conical bore of one end wall of the cylinder, said first axle being connected to a drive mechanism including a gear box mounted on the fourth plate, a second axle having a head with a tapering surface matching the taper of the conical bore in the other end wall of the sleeve cylinder, said second axis being mounted for reciprocal movement on said third axis and extending between the first and second plates and means for reciprocating the second axle from a position extending into the conical bore to chuck the cylinder between the first and second axles and a withdrawn position enabling removal of said cylinder.

9. A printing press according to claim 2, which includes means for supporting an ink pan in the desired working relationship with the printing cylinder, said means for supporting including an arm having one end connected to the ink pan, arm mounting means for supporting the other end of the arm on one of the side frame members for pivotal movement around a vertical axis and for movement along said vertical axis to raise and lower said pan.

10. A printing press according to claim 9, wherein the printing press is a rotogravure press, said printing cylinder being a rotogravure cylinder and said arm mounts the ink pan directly beneath said printing cylinder.

11. A printing press according to claim 2, wherein the printing press is a flexo printing press and includes a second sub-frame containing an ink pan, an inking roll and a transfer roll, said main frame having means for forming a pivotal mounting of said second sub-frame thereon and means for holding the transfer roll in contact with the printing cylinder, said press includes transfer means for removing printing elements from the press including an arm having one end forming a releasable connection for the second sub-frame, arm mounting means for supporting the arm on one side frame member of the main frame for pivotal movement about a vertical axis and means for raising and lowering the arm on said vertical axis.

12. A printing press comprising a main frame having a pair of spaced apart side frame members, an impression roll mounted for rotation in the main frame and extending between said spaced apart pair of side frame members and rotating on a first axis, a sub-frame, means mounting the sub-frame in the main frame for movement around a second axis offset from the first axis, said means for mounting enabling movement along said second axis and skewing of said second axis relative to said first axis, chucking means for releasably mounting a printing cylinder for rotation on a third axis being mounted on said sub-frame, means for pivoting the sub-frame on said second axis to move a printing surface of the printing cylinder into printing engagement with a web extending between said printing cylinder and impression roll, means mounted on said sub-frame for applying printing ink to said printing cylinder, means including a plurality of rollers mounted in the main frame for receiving a web entering the press, guiding the web to pass between the impression roll and printing cylinder and for guiding the web out of the press, means mounted on the sub-frame for rotating said printing cylinder, and means mounted on one of the side frame members for pivotable movement from a position beneath a printing cylinder to a position outside of said frame and including an arm supporting an ink pan beneath said cylinder, means for raising and lowering said arm so that the ink pan engages said cylinder when the cylinder is released by said chucking means so that the pan and cylinder can be removed from the press simultaneously.

13. A printing press according to claim 12, wherein the arm supporting the ink pan includes a pan frame having means for releasably connecting the ink pan thereto.

14. A printing press according to claim 13, wherein the pan frame is pivotably mounted on the arm.

15. A printing press according to claim 12, wherein the means for raising and lowering said arm includes a track disposed on the end of one of the side frame members, a carriage having rollers riding on said track, said carriage having a pivotable connection to said arm, and a threaded member for raising and lowering said carriage on said track.

16. A printing press according to claim 12, wherein the means for applying printing ink includes a positioning assembly mounted on each side of said third axis, one of said positioning assemblies releasably mounting a doctor blade holder and the other of said positioning assemblies releasably mounting an ink applicator so that during the removal of the ink pan and cylinder, the ink applicator and doctor blade holder are also removed while the positioning assemblies remain in said sub-frame.

17. A rotogravure printing press comprising a main frame having a pair of spaced apart side frame members, an impression roll mounted for rotation in the main frame and extending between said spaced apart pair of side frame members and rotating on a first axis, a sub-frame, means mounting the sub-frame in the main frame for movement around a second axis offset from the first axis, chucking means for releasably mounting a printing cylinder for rotation on a third axis being mounted on said sub-frame, means for pivoting the sub-frame on said second axis to move a printing surface of the printing cylinder into printing engagement with a web extending between said printing cylinder and impression roll, means mounted on said sub frame for applying printing ink to said printing cylinder, means including a plurality of rollers mounted in the main frame for receiving a web entering the press, guiding the web to pass between the impression roll and printing cylinder and for guiding the web out of the press, means mounted on the sub-frame for rotating said chucking means and printing cylinder on the third axis, and means mounted on one of the side frame members for pivotable movement from a position beneath a printing cylinder to a position outside of said frame, said means including an arm supporting an ink pan beneath said cylinder, means raising and lowering said arm so that the ink pan engages said cylinder when the cylinder is released by said chucking means so that the pan and cylinder can be removed from the press simultaneously.

* * * * *